US008251001B2

(12) United States Patent
Matsumoto et al.

(10) Patent No.: US 8,251,001 B2
(45) Date of Patent: Aug. 28, 2012

(54) CIRCULAR STITCHER FOR SEWING MACHINE

(75) Inventors: Nobuaki Matsumoto, Nagoya (JP); Yasuhiro Watanabe, Tokoname (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 377 days.

(21) Appl. No.: 12/585,497

(22) Filed: Sep. 16, 2009

(65) Prior Publication Data

US 2010/0192824 A1 Aug. 5, 2010

(30) Foreign Application Priority Data

Feb. 4, 2009 (JP) ..... 2009-023672

(51) Int. Cl.
*D05B 39/00* (2006.01)

(52) U.S. Cl. ..... 112/470.17

(58) Field of Classification Search ..... 112/470.17, 112/470.11, 470.14, 136, 308, 309, 470.13, 112/14

See application file for complete search history.

(56) References Cited

U.S. PATENT DOCUMENTS

| | | | | |
|---|---|---|---|---|
| 2,359,713 | A * | 10/1944 | Kessler et al. | 112/470.17 |
| 3,046,918 | A * | 7/1962 | Hess | 112/470.17 |
| 3,374,753 | A * | 3/1968 | Rakacs | 112/470.17 |
| 3,410,237 | A * | 11/1968 | Hanyu | 112/102 |
| 5,647,292 | A * | 7/1997 | Morgulis et al. | 112/470.17 |
| 7,527,005 | B2 | 5/2009 | Matsumoto et al. | |

FOREIGN PATENT DOCUMENTS

JP A-2008-253725 10/2008

* cited by examiner

*Primary Examiner* — Tejash Patel
(74) *Attorney, Agent, or Firm* — Oliff & Berridge, PLC

(57) ABSTRACT

A circular stitcher including a main base attachable to an upper surface of a sewing machine bed or to an upper surface of a needle plate; a movable base provided at the main base so as to be movable in a predetermined direction; a pin including a needle capable of piercing the workpiece cloth and having an engagement portion, and a holder that holds a base end of the needle; a lock element that is provided at the movable base and that locks and unlocks the engagement portion of the needle; and an operation element that is provided at the movable base and that allows a finger operation of the movable base in the predetermined direction by a user.

6 Claims, 9 Drawing Sheets

CIRCULAR STITCHER FOR SEWING MACHINE

This application is based upon and claims the benefit of priority from the prior Japanese Patent Application 2009-023672, filed on, Feb. 4, 2009 the entire contents of which are incorporated herein by reference.

FIELD

The present disclosure relates to a circular stitcher for a sewing machine that forms circular stitches on a workpiece cloth by rotating the workpiece cloth about a pin pierced through the workpiece cloth at a position laterally spaced from a needle drop position of a sewing needle.

BACKGROUND

Conventionally, when forming circular stitches with a sewing machine, a circular stitcher having a needle provided on it is attached to the sewing machine. The needle secures the workpiece cloth at a pivotal point laterally spaced from the sewing needle drop point. Then, the workpiece cloth is rotated about the needle by the feed dog to form circular stitches in coordination with the vertical movement of the needle bar having a sewing needle attached to it. One example of such circular stitcher is disclosed, for example, in patent publication JP 2008-253725 A.

The circular stitcher disclosed in JP 2008-253725 A is provided with a main base attachable to the upper surface of a sewing machine bed or a needle plate, a pin support (movable base) provided laterally movably on the main base, and a pin supported by a cloth slider of the movable base. The pin support extends laterally and has an upwardly oriented needle at its right end relatively closer to the sewing needle drop point. The pin support is locked in place at its left end by a lock element provided on the underside of the cloth slider.

Since the circular stitcher rotatably supports the workpiece cloth on its upper surface, it is preferable to reduce the clearance between the circular stitcher and the needle plate as much as possible. This is because increased difference in height between the upper surface of elements such as the support pin and the movable base and height of the upper surface of needle plate creates steps on the workpiece cloth which may cause the start point and the end point of the circular stitch to be incoincidental to result in a poor looking circular stitches. To address such concern, the movable plate is configured to be generally planar such that the thickness or height of the movable base and the pin are configured at relatively small dimensions with only the triangular shaped cloth slider protruding from the upper surface of the movable base so as not to prevent the rotation of the workpiece cloth.

Circular stitcher disclosed in JP 2008-253725 A makes adjustments in positioning of the movable base and consequently the needle by laterally moving the movable base depending on the size of the circular stitch to be sewn. However, because the circular stitcher inclusive of the movable base is generally planar in structure, the user or the operator may have a hard time in repositioning the movable base in the absence of a handle, for example, for user operation.

SUMMARY

An object of the present disclosure is to provide a circular stitcher for sewing machine which can be readily repositioned according to the various sizes of circular stitches to be sewn to provide improved user operability.

In one aspect of the present disclosure, there is provided a circular stitcher for a sewing machine including a sewing machine bed, a needle plate, and a feed dog, the circular stitcher having a needle that pierces a workpiece cloth at a laterally spaced position from a sewing needle drop point to form circular stitches on the workpiece cloth by rotating the workpiece cloth about the needle by the feed dog, the circular stitcher including a main base attachable to an upper surface of the sewing machine bed or to an upper surface of the needle plate; a movable base provided at the main base so as to be movable in a predetermined direction; a pin including the needle capable of piercing the workpiece cloth and having an engagement portion, and a holder that holds a base end of the needle; a lock element that is provided at the movable base and that locks and unlocks the engagement portion of the needle; and an operation element that is provided at the movable base and that allows a finger operation to move the movable base in the predetermined direction by a user.

According to the above described configuration, the user is allowed to move the movable base by operating the operation element by the user's fingers, for example. Thus, adjustments can be made in the positioning of the movable base relative to the main base depending on the size of the circle to be sewn. Further, the engagement portion is formed on the needle, and by locking the engagement portion by the lock mechanism, the pin is attached to the movable base and when the lock effected by the lock element is cancelled, the pin can be removed from the movable base. Thus, the pin can be securely attached to the movable base while allowing easy attachment and detachment of the pin to provide an advantageous operability.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

Figure 1:
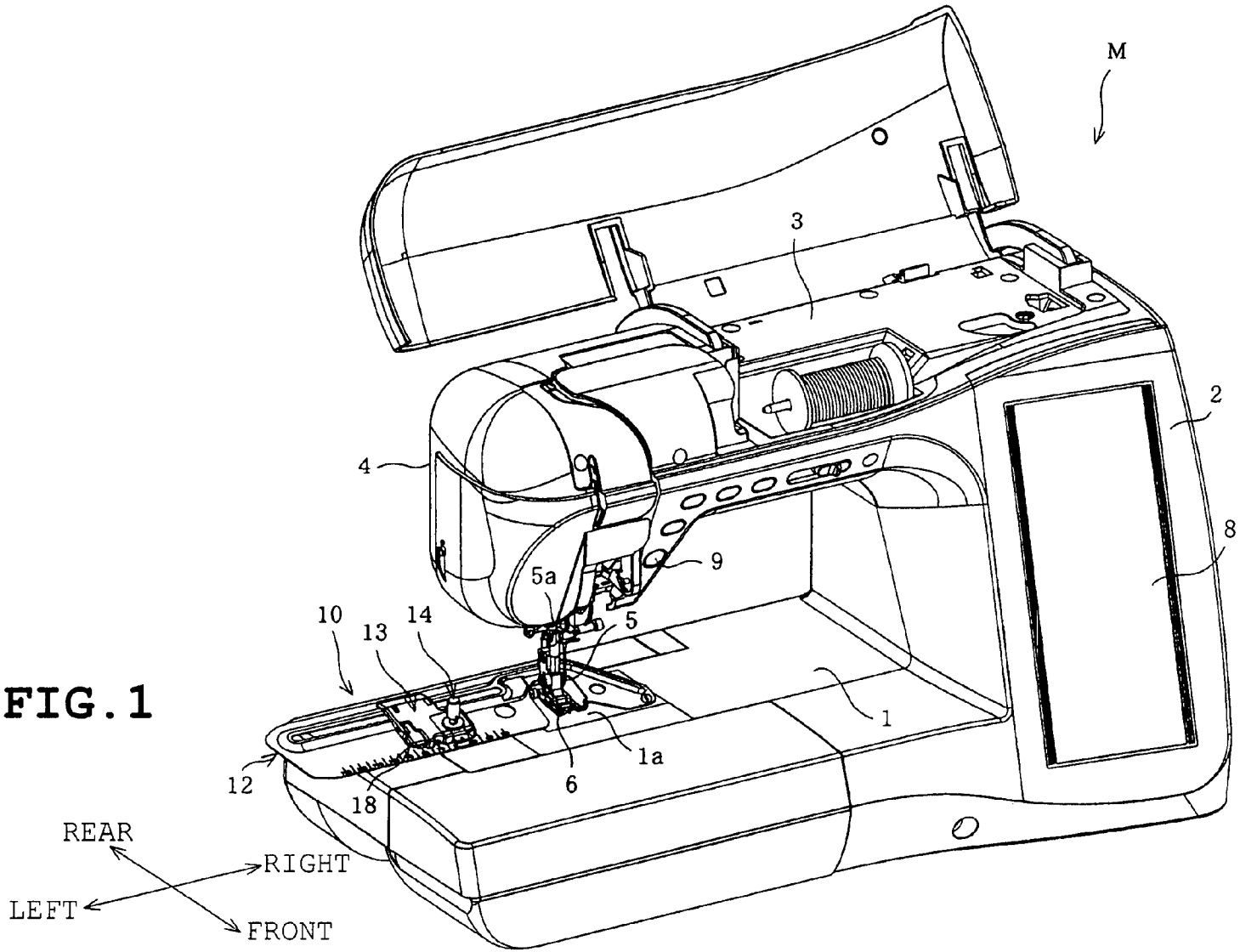
FIG. 1 is a perspective view of a sewing machine with an attachment of a circular stitcher of a first exemplary embodiment.

A first exemplary embodiment applying the present disclosure to a household sewing machine will be described hereinafter with reference to FIGS. 1 to 9B. In the following description, the direction in which the user or the operator positions himself relative to the sewing machine is defined as the front.

A sewing machine M includes a bed 1, a pillar 2 standing on the right end of bed 1, an arm 3 extending leftward over bed 1 from the upper end of pillar 2, and a head 4 provided on the left portion of arm 3. Arm 3 contains a laterally extending sewing machine main shaft not shown and a sewing machine motor not shown that rotates the sewing machine main shaft.

Though not shown in detail, head 4 is provided with a needle bar 5*a* having a sewing needle 5 attached to its lower end. Near sewing needle 5, presser foot 6 is provided that applies pressure on a workpiece cloth CL, only shown in FIG. 6, from above. Though also not shown, arm 3 further contains components such as a needle bar drive mechanism that vertically moves needle bar 5*a* based on the rotation of the sewing machine main shaft, a needle bar swing mechanism that swings needle bar 5*a* in a direction (left and right direction) orthogonal to a cloth feed direction, and a thread take-up drive mechanism that vertically moves the thread take-up in synchronism with the vertical movement of needle bar 5*a*.

Figure 2:
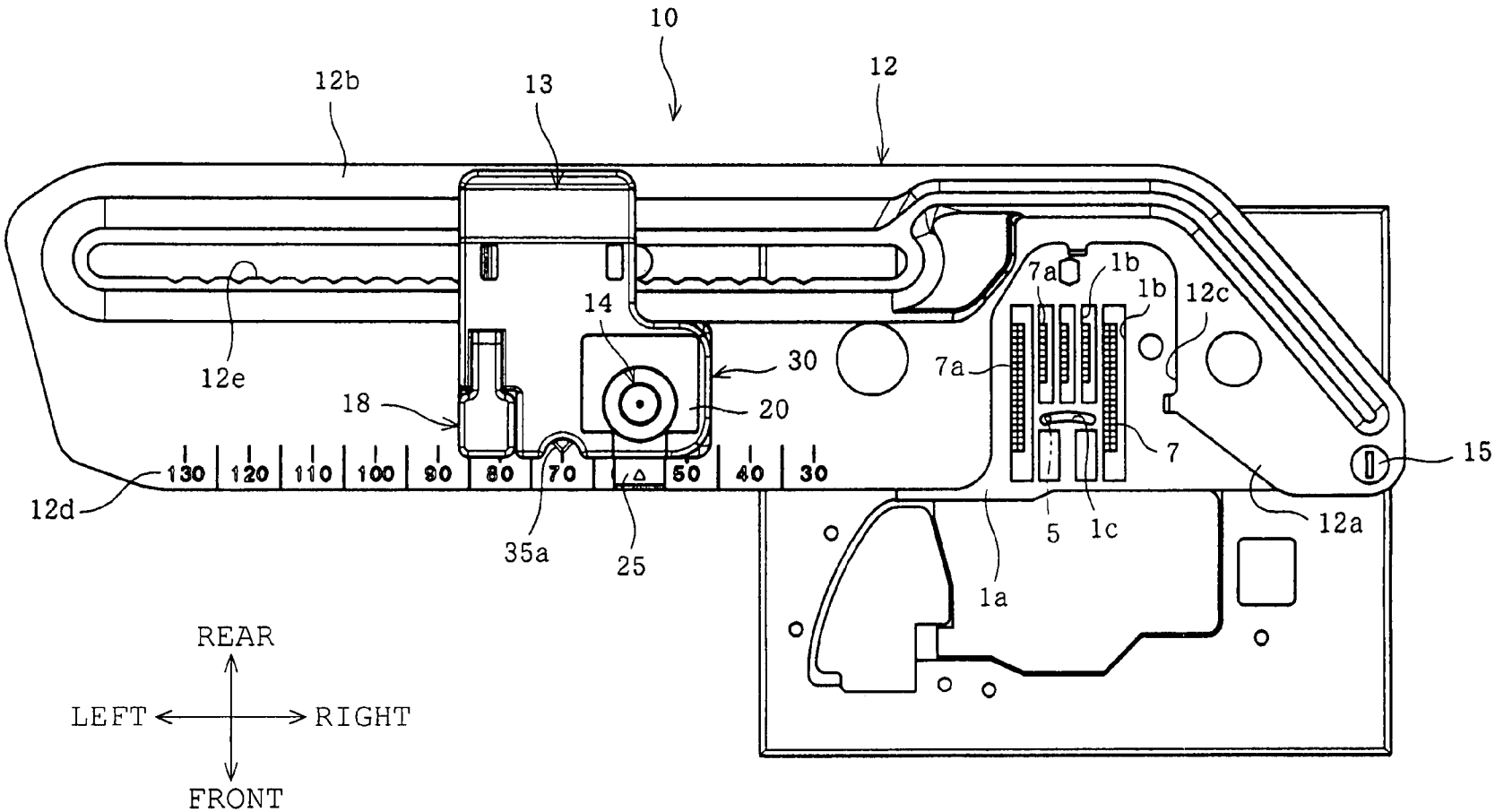
FIG. 2 is a plan view of a circular stitcher.

Provided below a needle plate 1*a* placed on the upper surface of bed 1 are a feed dog vertically moving mechanism (not shown) that vertically moves a feed dog 7 shown in FIG. 2 for feeding workpiece CL, a feed dog longitudinally moving mechanism (not shown) that longitudinally moves feed dog 7, a full rotary shuttle (not shown) that contains a bobbin thread bobbin (not shown) wound with bobbin thread and that forms stitches in cooperation with sewing needle 5, and a thread cutting mechanism (not shown) that cuts the needle thread and the bobbin thread. Further, as shown in FIG. 2, needle plate 1*a* has a plurality square holes 1*b* through which a plurality of teeth 7*a* formed on feed dog 7 is moved up and down and a relatively wide and curved needle hole 1*c* through which sewing needle 5 can be inserted.

On the front face of pillar 2, a large LCD (liquid crystal display) 8 capable of color display is provided for displaying screens such as a menu screen, a pattern input screen, and a pattern selection screen. On the front face of arm 3, various switches such as a start/stop switch 9 for instructing starting and stopping of a sewing operation are provided. On the upper surface of needle plate 1*a*, a circular stitcher 10 is attached for forming circular stitches. Circular stitcher 10 forms circular stitches by piercing a later described needle 11 shown in FIG. 3 through workpiece cloth CL at a position laterally spaced from a needle hole 1*c* or a sewing needle drop point and rotating workpiece cloth CL by feed dog 7 about needle 11 in coordination with the vertical movement of needle bar 5*a*.

Next, a description will be given on circular stitcher 10 with reference to FIGS. 2 to 6.

Circular stitcher 10 includes a main base 12 detachably attached to the upper surface of needle plate 1*a*, a movable base 13 movably attached on main base 12, and a pin 14 which is provided with needle 11 and which is disengagably engaged with movable base 13.

Referring to FIG. 2, main base 12 is provided integrally with a mount 12*a* secured unmovably on needle plate 1*a* by a screw 15, and a linear guide 12*b* extending leftward from mount 12*a*. Mount 12*a* has an opening 12*c* opening up toward the front side of the sewing machine to embrace presser foot 6 within in it. On the front edge of guide 12*b*, a scale 12*d* marked at a predetermined interval of 5 mm, for example, is provided for guidance in positioning movable base 13. On the rear portion of guide 12*b*, a linear rail groove 12*e* runs in the lateral (left and right) direction and on one side of rail groove 12*e*, a plurality of V-shaped grooves are defined at predetermined interval of 5 mm, for example.

Figure 3:
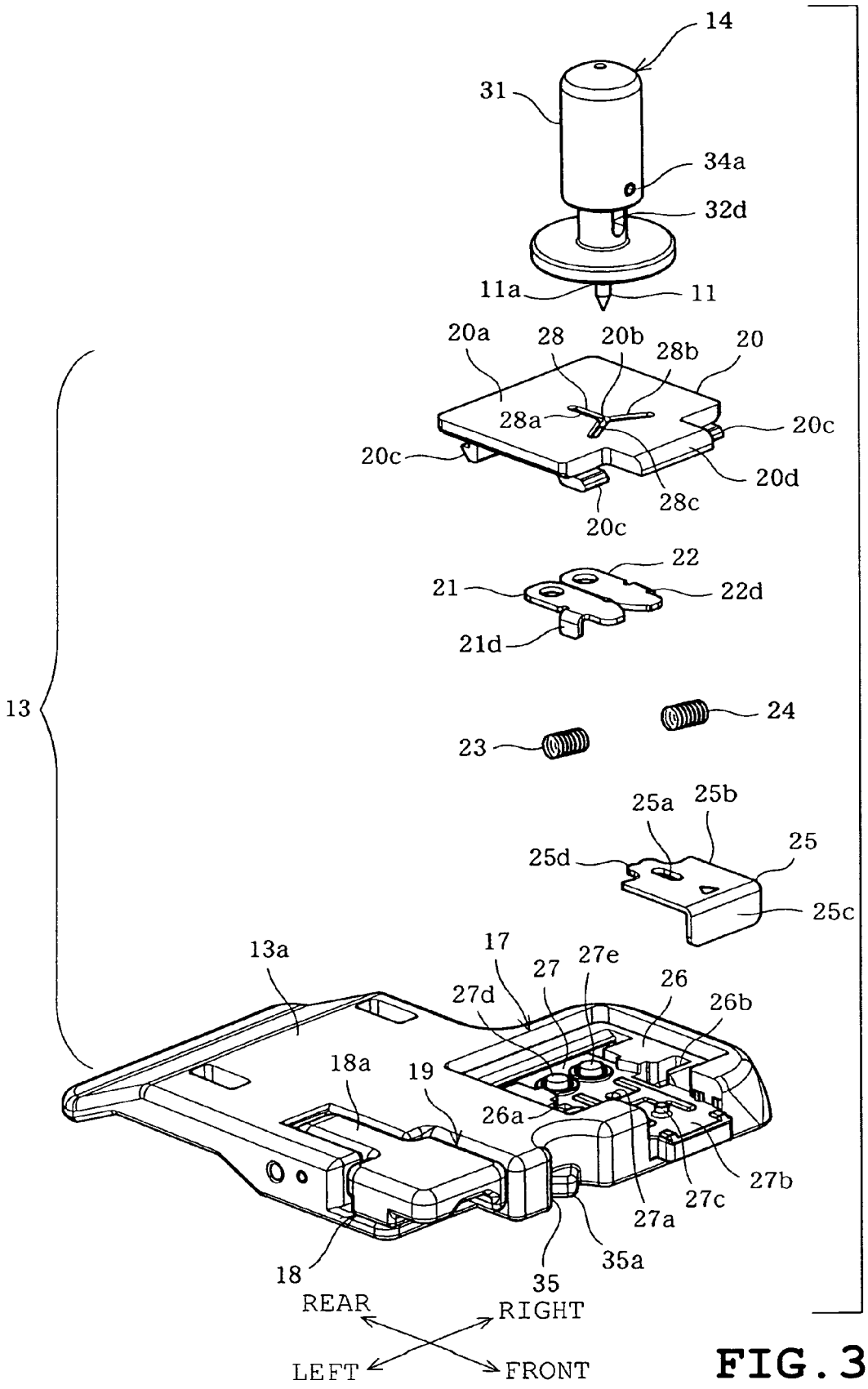
FIG. 3 is a perspective view of a movable base with an exploded needle holder and a pin.
Figure 6:
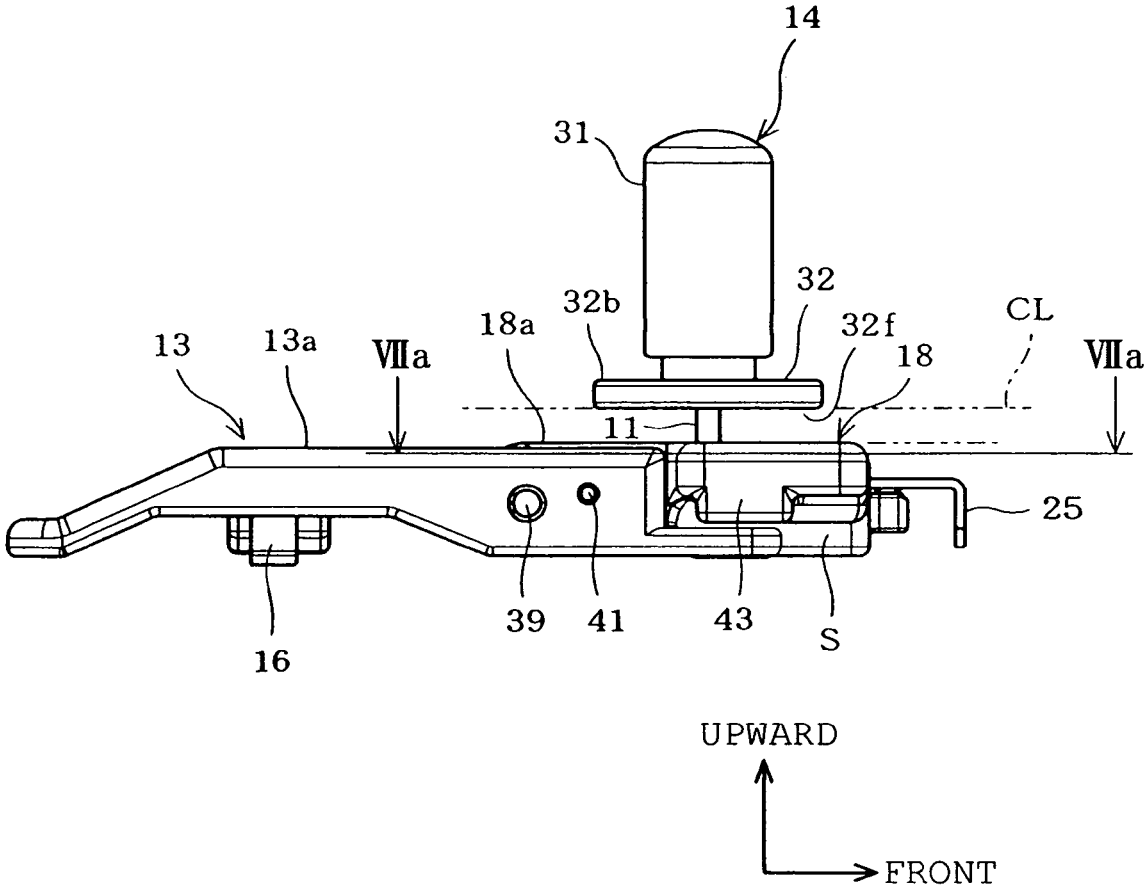
FIG. 6 is a left side view of the movable base with the pin attached to the needle holder.

As can be seen in FIG. 3, movable base 13 is generally planar and has an engagement portion 16 shown in FIG. 6 provided on its rear portion that protrudes toward the rear side so as to be engagable with rail groove 12*e*. Movable base 13 is laterally movable along a predetermined direction (left and right direction) and is retained at a given position by the engagement of engagement portion 16 with rail groove 12*e*. As movable base 13 is laterally moved, engagement portion 16 is engaged intermittently with the V-shaped grooves provided on one side of rail groove 12*e*, which can be felt by the user as a slight vibration.

Movable base 13, when viewed from the top, is L-shaped as viewed in FIG. 2 such that its front-half right side portion projects toward the sewing needle drop point. The front-half right side portion has a rectangular recess 17 for accommodating a later described holder, where as the front-half left side portion has a recess 19 for accommodating a later described operation element 18.

Recess 17 (lower needle holder) receives an upper needle holder 20. Within recess 17 enclosed by upper needle holder 20, a plurality of engagement catches 21 and 22 and compression coil springs 23 and 24, both being provided in a set of two in the present exemplary embodiment are provided along with an operation plate 25 disposed slidably relative to recess 17.

Figure 4:
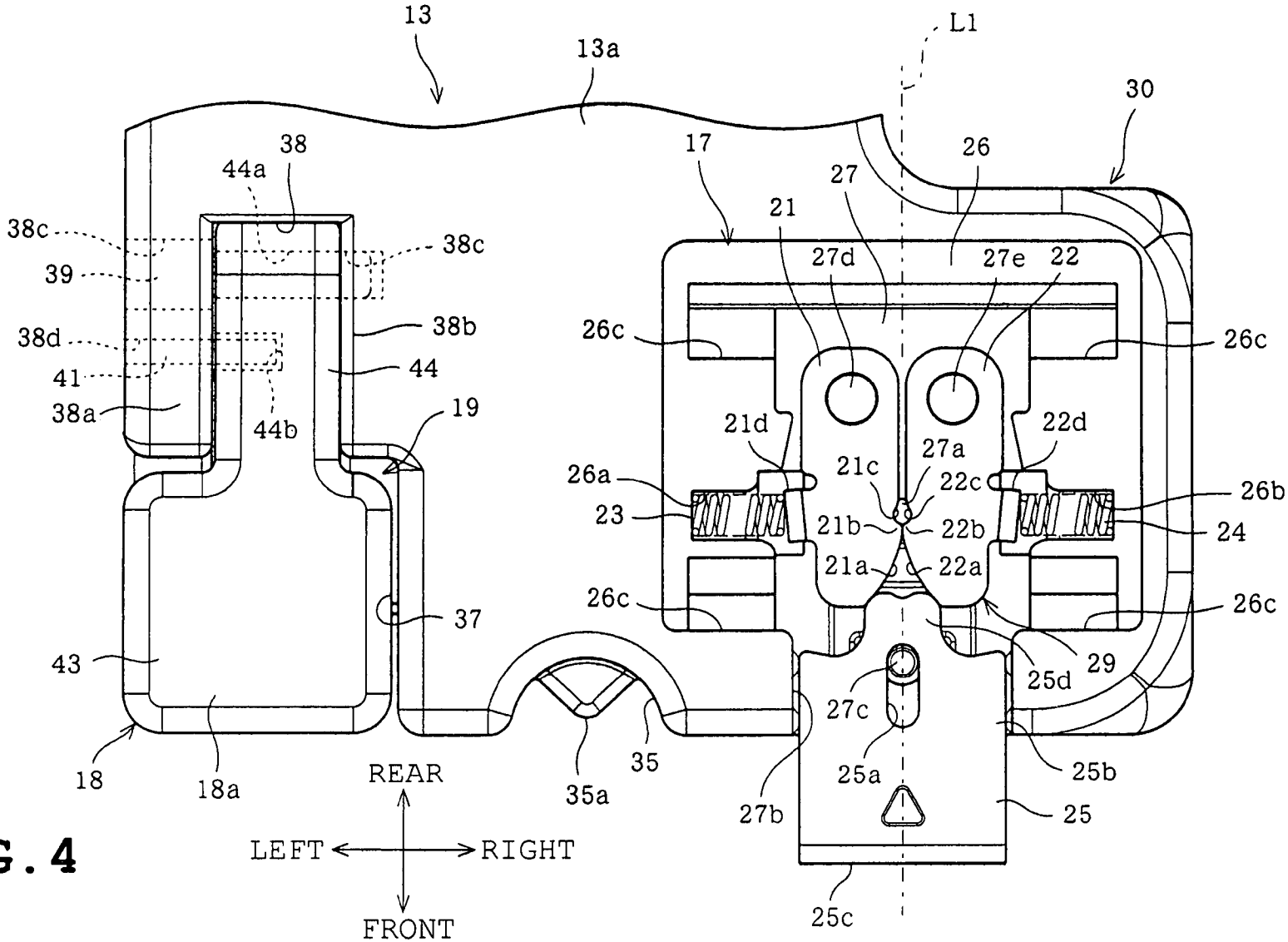
FIG. 4 is an enlarged plan view of a front half of the movable base with an upper needle holder removed.

More specifically, recess 17 comprises a first recess 26 defining a rectangular space that is as deep as the thickness of upper needle holder 20, and a second recess 27 running further downward from the lateral mid portion of the first recess 26. As can be seen in FIGS. 3 and 4, at the substantial center of the second recess 27, an insertion hole 27*a* is defined to allow insertion of the tip of needle 11. At both lateral sides of the first recess 26, spring accommodations 26*a* and 26*b* communicating with the second recess 27 are defined so as to confront each other over insertion hole 27*a* in plan view. At the front portion of the second recess 27, a guide section 27*b* including a concaved portion for guiding the longitudinal (forward and reward) movement of operation plate 25 protrudes outward in communication with the atmosphere. At the central portion of guide section 27*b*, a guide projection 27*c* is formed which exhibits a pin-like form. The second recess 27 is further provided with a couple of left and right cylindrical support sections 27*d* and 27*e* behind insertion hole 27*a*. As shown in FIG. 4, recess 17 is provided with mounts 26*c* defined as concavities at four corners of the first recess 26.

As can be seen in FIG. 3, operation plate 25, functioning as an operation portion, comprises a guide subject 25*b* having a guide hole 25*a* defined on it and a press section 25*c* which is a downwardly bent section at the front end of guide subject 25*b*. Referring now to FIG. 4, guide hole 25*a* is formed as a long hole that extends in the longitudinal direction to establish a fitting engagement with a guide projection 27*c* provided in recess 17, thereby allowing longitudinal movement of operation plate 25. At the rear end center of guide subject 25*b*, a spreader 25*d* projects rearward in a mountain profile.

Engagement catches 21 and 22 both extend in the longitudinal direction such that engagement catch 21 is supported swingably by the left side support section 27*d* and engagement catch 22 is supported swingably by the right side support section 27*e*. As can be seen in FIG. 4, engagement catches 21 and 22 confront each other over insertion hole 27*a* and are symmetrical. Insertion hole 27*a* will be described in detail in connection with a later described recess 11*a* of needle 11 shown in FIG. 7A. The tips of engagement catches 21 and 22 are provided with slopes 21*a* and 22*a* respectively, which are each capable of being placed in slidable contact with either side of spreader 25*d* of operation plate 25. Slopes 21*a* and 22*a* of engagement catches 21 and 22 define a V-shape.

At the valley of the V-shape defined by mating slopes 21*a* and 21*b*, a contact section 21*b* is formed which is capable of establishing contact with the corresponding feature of engagement catch 22. In the immediate proximity of contact section 21*b*, a fitting hole 21*c* allowing fitting engagement of a recess 11*a* of needle 11 is defined. Engagement catch 21 is further provided with a spring receiver 21*d* which is downwardly bent to face spring accommodation 26*a*. Engagement catches 21 and 22 are symmetrical relative to a straight line L1 shown in FIG. 4 that passes through the center of insertion hole 27*a* to split recess 17 in equal halves. As can be understood from the foregoing description, engagement catch 22 is also provided with an contact section 22*b* capable of contacting engagement catch 21, fitting hole 22*c* allowing fitting engagement of recess 11*a* of needle 11 and a spring receiver 22*d* that faces spring accommodation 26*b*.

A compression coil spring 23 residing in spring accommodation 26*a* is placed in contact with spring receiver 21*d*, whereas a compression coil spring 24 residing in spring accommodation 26*b* is placed in contact with spring receiver 22*d*. Thus, engagement catches 21 and 22 are biased to clamp recess 11*a* of needle 11 and contact each other at contact sections 21*b* and 22*b*. Operation plate 25 contacts slopes 21*a* and 21*b* at its spreader 25*d*, with the rear side inner surface of guide hole 25*a* contacting the rear side surface of guide projection 27*c*.

Figure 7A:
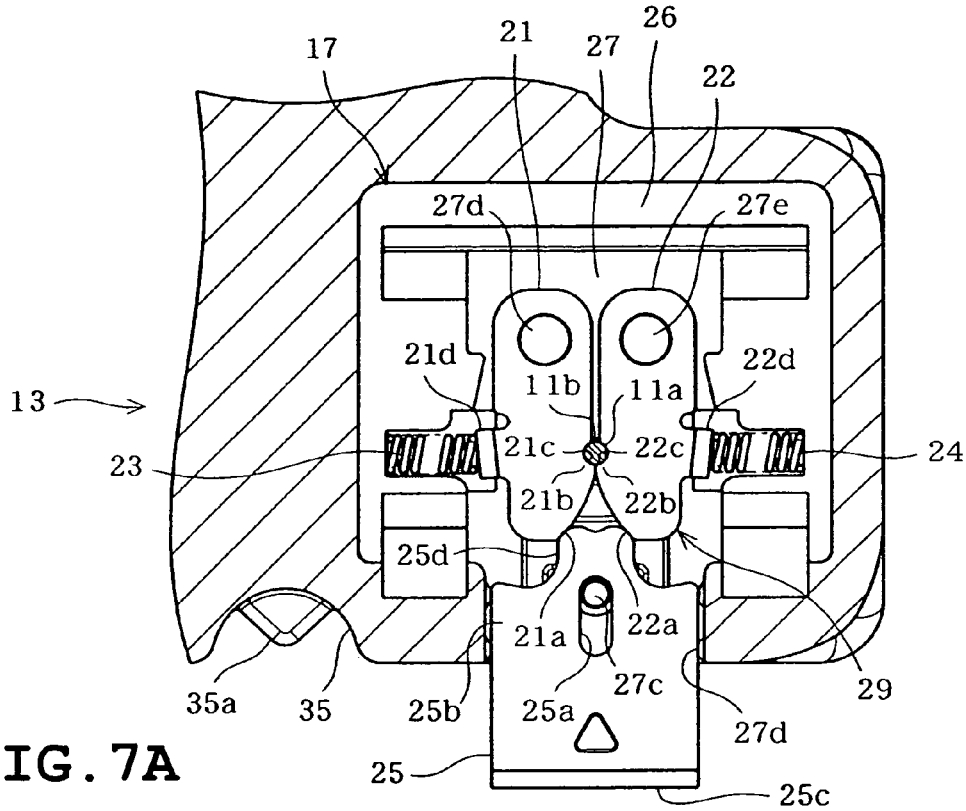
FIG. 7A is an enlarged cross sectional view of the needle holder taken along line VIIa-VIIa of FIG. 6.
Figure 7B:
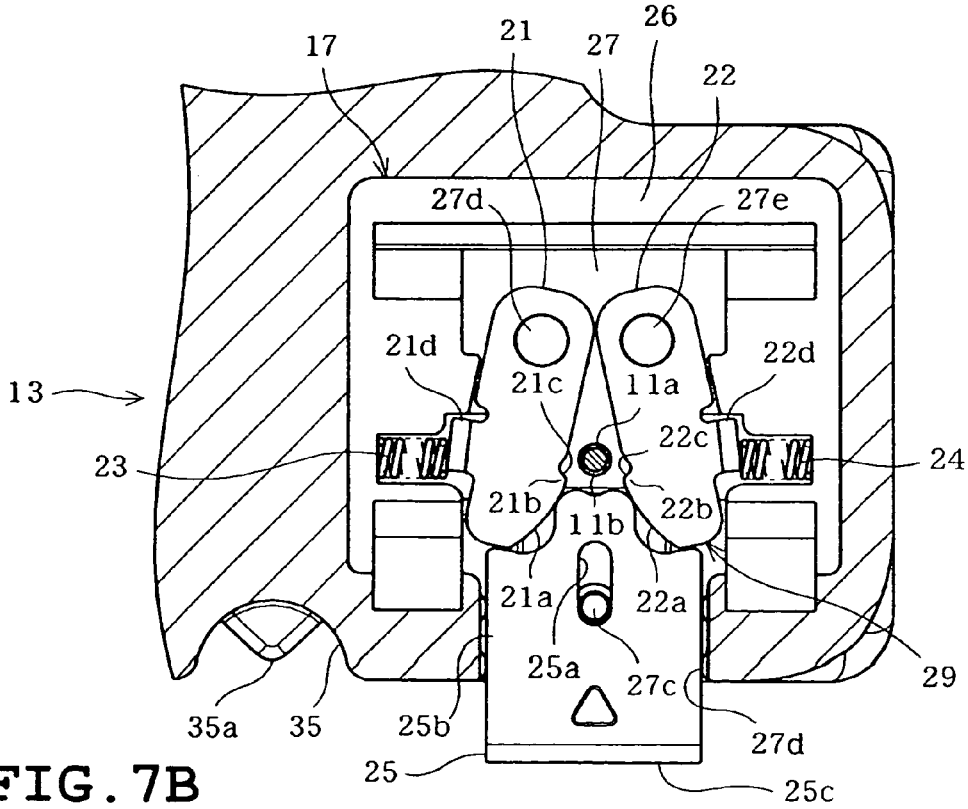
FIG. 7B corresponds to FIG. 7A with the lock effected by a lock element cancelled.
Figure 8A:
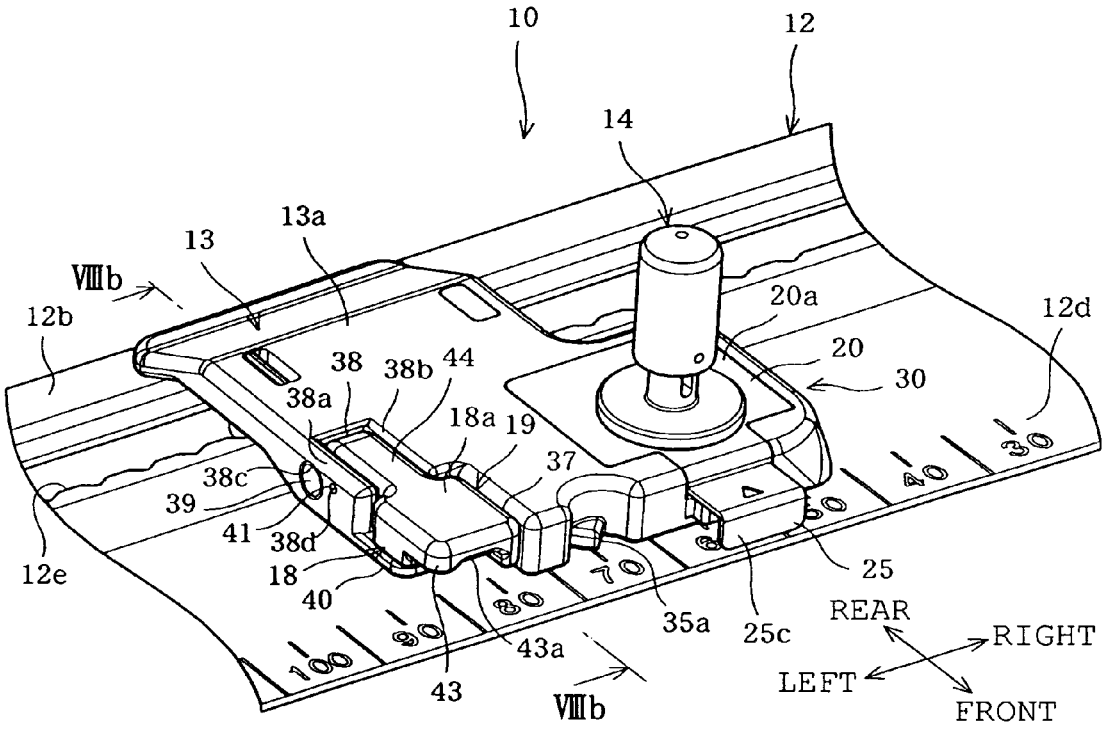
FIG. 8A is an enlarged perspective view of the proximity of the movable base with the operation element in the stored position.
Figure 8B:
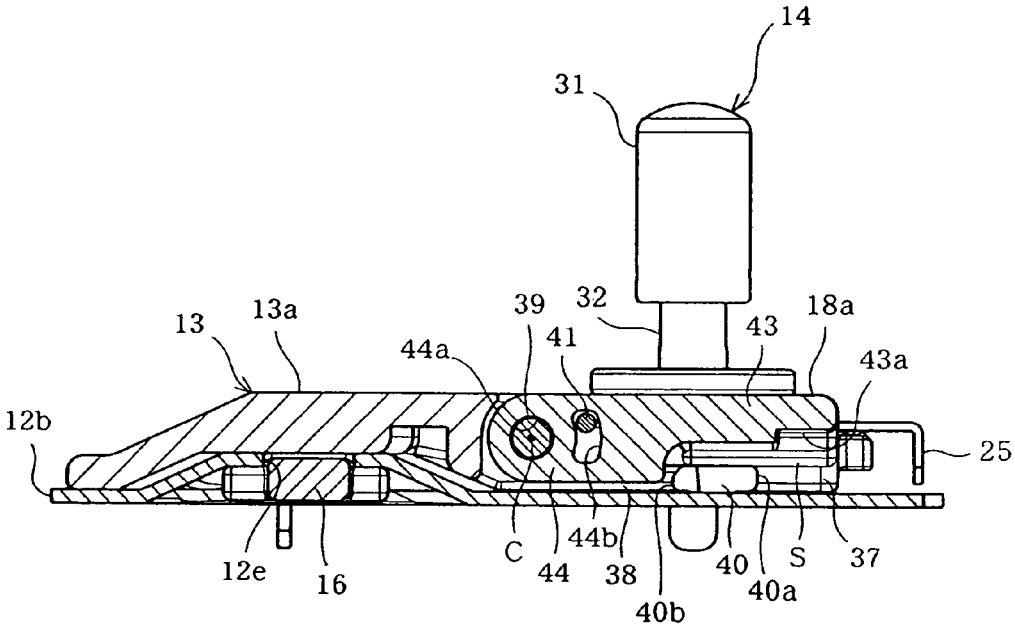
FIG. 8B is a cross sectional view taken along line VIIIb-VIIIb.

When press section 25*c* of operation plate 25 is pressed rearward, spreader 25*d* of operation plate 25 contacts slopes 21*a* and 22*a* of engagement catches 21 and 22 and proceeds further rearward while maintaining the contact. As spreader 25*d* proceeds further rearward, it spreads open engagement catches 21 and 22 against the bias of compression coil springs 23 and 24 to place engagement catches 21 and 22 in an opened reverse V-shape as shown in FIG. 7B. Engagement catches 21 and 22, compression coil springs 23 and 24, and operation plate 25 constitute lock element 29.

Referring again to FIG. 3, upper needle holder 20 is configured as a rectangular plate that is fitted into the first recess 26. The upper surface of upper needle holder 20 constitutes a placement surface 20*a* for placement of workpiece cloth CL, and upper needle holder 20 is configured such that placement surface 20*a* and an upper surface 13*a* of movable base are coplanar. Placement surface 20*a* is provided with a through hole 20*b* at its substantial center for penetration of needle 11, and a plurality of (three in the present exemplary embodiment) grooves 28*a*, 28*b*, and 28*c* extending radially from through hole 20*b*, which grooves collectively define a Y-shaped needle guide 28 in plan view. Each of grooves 28*a*, 28*b*, and 28*c* comprise a shallow, linear groove that each define a 120 degree angular interval with its neighboring groove and communicates with the central through hole 20*b* to guide the tip of needle 11 which is later described as a conical section. The above described arrangement of grooves 28*a*, 28*b*, and 28*c* facilitates insertion of needle 11 into the central through hole 20*b* and at the same time and serves as an indicator to improve the visibility of through hole 20*b*. At the four corners of upper needle holder 20, mount subjects 20*c* are provided that are engaged with mount sections 26*c* of recess 17, and at the front end of upper needle holder 20, a projection 20*d* is provided that is disposed along guide section 27*b*. As described above, recess 17 serving as the lower needle holder and being provided integrally with movable base 13 constitutes needle holder 30 that allows detachable attachment of needle 11 along with upper needle holder 20 and lock element 29.

Next, a description will be given on pin 14 with reference to FIGS. 5A to 5C.

Pin 14 comprises a needle 11, a holder 31 that holds the base end of needle 11, a cover 32 provided movably on holder 31, and a compression coil spring 33 disposed between holder 31 and cover 32.

Needle 11 comprises a cylindrical section 11*b* that extends from holder 31 and a conical section 11*c* formed at the tip of cylindrical section 11*b*. Recess 11*a* is provided on a portion of cylindrical section 11*b* that is relatively closer to its tip but spaced away toward the base end of needle 11 relative to conical section 11*c*. Conical section 11*c* constitutes the pointed tip of needle 11 that facilitate insertion of needle 11 into the above described through hole 20*b* and insertion hole 27*a*. Recess 11*a* is formed, for example, around the entire circumference of cylindrical section 11*b*. As can be seen in FIG. 5A, upper portion 11*d* and lower portion 11*e* situated above and below recess 11*a* respectively are tapered by a predetermined angle that facilitates piercing and unpiercing of needle 11 to and from workpiece cloth CL and that allows the lock on recess 11*a* to be effected by lock element 29. Distance H indicated in FIG. 5C between recess 11*a* and conical section 11*c* is configured at a distance that provides sufficient hold of the tip of needle 11 by insertion hole 27*a*. Through hole 20*b* and insertion hole 27*a* of needle holder 30 both act as a receiving end of needle 11 and are formed in a shape that follow along the outer periphery of cylindrical section 11*b* so that the outer periphery of the tip of needle 11 is supported so as to be rattle free. Thus, needle 11 is held in fitting engagement at its recess 11*a* with engagement catches 21 and 22 of lock element 29 as well as being held immediately above recess 11*a* of cylindrical section 11*b* by through hole 20*b* of needle holder 30 and immediately below recess 11*a* of cylindrical section 11*b* by insertion hole 27*a* of needle holder 30.

Holder 31 is made of synthetic material which is provided integrally with a cylindrical section 31*a* and a circular top 31*b* so as to exhibit a generally cylindrical cap form. As can be seen in FIGS. 5A and 5B, at a portion proximal to the lower end of cylindrical section 31*a*, a pair of holes 31*c* and 31*d* is defined so as to be arranged symmetrical to axis L2 of cylindrical portion 31*a* at a 180 degree angular interval between them. Pin holes 31*c* and 31*d* receive pins 34*a* and 34*b* respectively such that one end of pins 34*a* and 34*b* are arranged so as to be coplanar with the outer periphery of cylindrical section 31*a* while the other end is secured within pin holes 31*c* and 31*d* so as to intrude radially inward into cylindrical section 31*a*. As shown in FIG. 5B, at the inner central portion of circular top 31*b*, a downwardly extending cylindrical needle holder 31*e* is formed which is provided with spring engagements 31*f* on its outer periphery. Needle holder 31*e* receives and provides a secure hold of the base end of cylindrical section 11*b* and spring engagements 31*f* establish engagement with the upper end of compression coil spring 33 shown in double dot chain line in FIG. 5B.

Cover 32 is made of synthetic resin material and comprises a cylindrical waist 32*a*, and a flange 32*b* formed integrally at the lower end of cylindrical waist 32*a*. The outer periphery of waist 32*a* is placed in sliding contact with the inner periphery of cylindrical section 31*a* of holder 31. At the inner center of waist 32*a*, an axially penetrating needle insert hole 32*c* is defined that allows slidable insertion of cylindrical section 11*b* of needle 11. Waist 32*a* is further provided with guide grooves 32*d* and 32*e* that allows insertion of pins 34*a* and 34*b* of holder 31. Guide grooves 32*d* and 32*e* run axially in a linear fashion within waist 32*a* and are disposed symmetrically relative to axis L2 with an angular interval of 180 degrees between them. Flange 32*b* is disc shaped and is greater in diameter compared to waist 32*a* and cylindrical section 31*a*. The underside of flange 32*b* defines a cloth presser 32*f* that presses workpiece cloth CL as can be seen in FIG. 6.

Figure 5C:
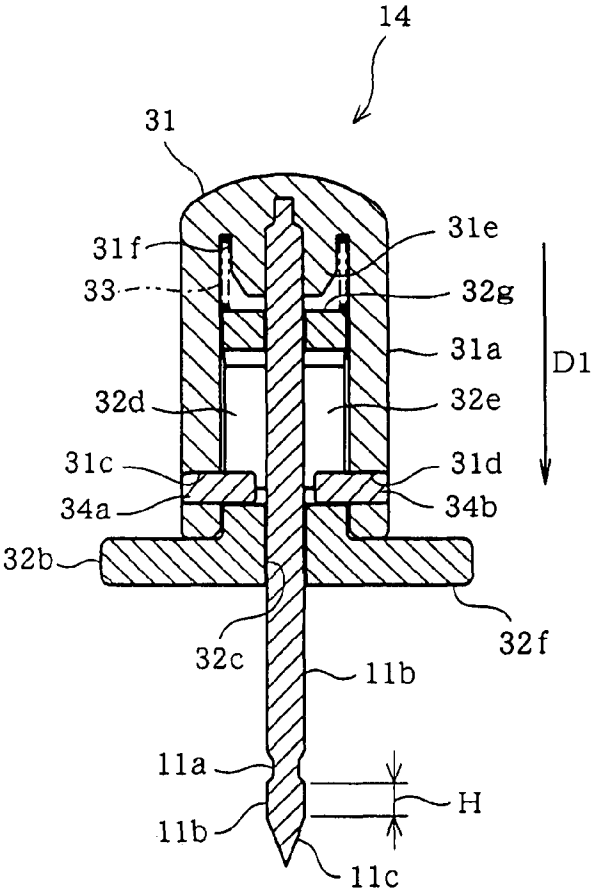
FIG. 5C corresponds to FIG. 5B showing the pin with the cover in the exposed position.
Figure 5B:
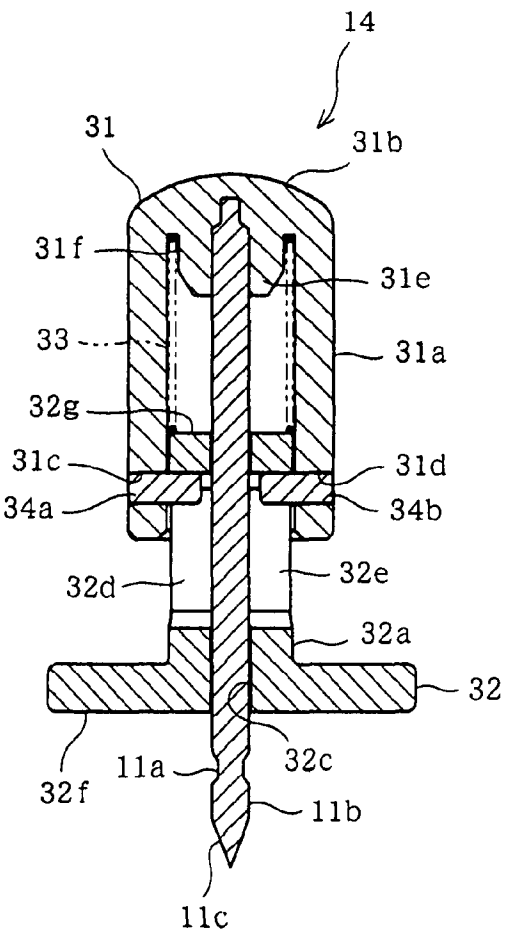
FIG. 5B is a cross sectional view taken along line Vb-Vb of FIG. 5A.
Figure 5A:
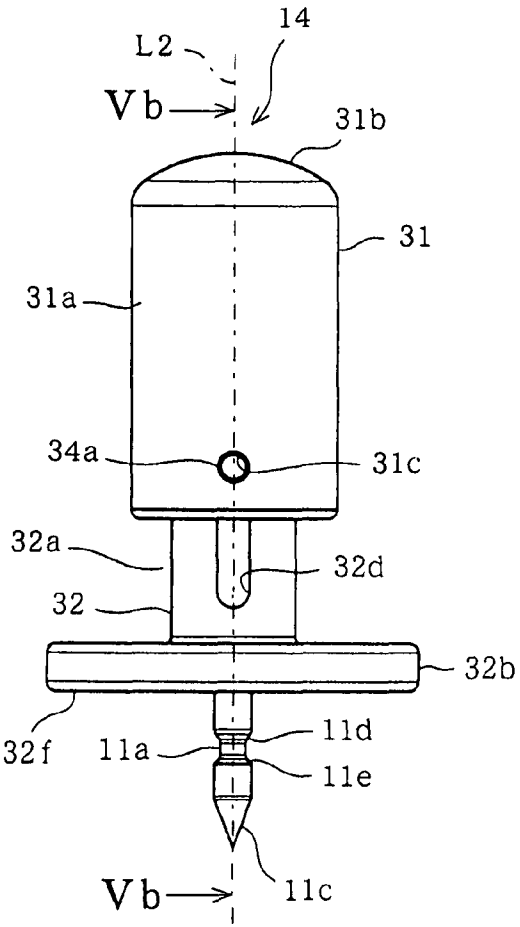
FIG. 5A is a front view of the pin with a cover placed in a covered position.

Cover 32 being guided by guide grooves 32*d* and 32*e* at its pins 34*a* and 34*b* is configured to be movable relative to holder 31 between a covered position shown in FIGS. 5A and 5B that covers needle 11 except for its tip and an exposed position shown in FIG. 5C that exposes the lower half of needle 11.

Compression coil spring 33 is an elastic element installed so as to be engaged at its upper end with a spring engagement 31*f* of holder 31 and biases upper end 32*g* of cover 32 downward at its lower end. The elasticity of compression coil spring 33 renders cover 32 to be biased toward covered position indicated by arrow D1 shown in FIG. 5C relative to holder 31.

Thus, as can be seen in FIGS. 5A and 5B, when pin 14 in the inoperative state is removed from needle holder 30, cover 32 is placed in the covered position to expose only the needle tip of needle 11. Thus, accidental contact of the user's fingers with the tip of needle 11 can be prevented as much as possible while also bringing the danger of the needle tip of needle 11 to the user's attention. As can be seen in FIG. 5C, on the other hand, when piercing needle 11 through the center of circular stitching located on workpiece cloth CL, cover 32 is moved to the exposed position by pushing up cover 32 relative to retainer 31 against the elasticity of compression coil spring 33. Thus, the user is allowed to pierce needle 11 through workpiece cloth CL or attach it to needle holder 30 while maintaining the exposed position of cover 32 by holding flange 32*b* of cover 32 for example.

When needle 11 of pin 14 is not attached to needle holder 30 of movable base 13, contact sections 21*b* and 22*b* of engagement catches 21 and 22 provided at lock element 29 are placed in mutual contact by the elasticity of compression coil springs 23 and 24 as can be seen in FIG. 4. When needle 11 is inserted into through hole 20*b* of upper needle holder 20 under such state, conical section 11*c* moves downward in sliding contact with fitting sections 21*c* and 22*c* of engagement catches 21 and 22 to cause needle 11 to slightly spread the spacing between engagement catches 21*c* and 22*c*. When recess 11*a* of needle 11 reaches fitting sections 21*c* and 22*c*, needle 11 is clamped in fitting engagement with engagement catches 21 and 22 as shown in FIG. 7A, and cylindrical section 11*b* situated immediately above and below recess 11*a* are held by through hole 20*b* and insert hole 27*a* of needle holder 30. Thus, needle 11 of pin 14 is attached to needle holder 30 without producing rattle.

When removing pin 14 from needle holder 30, press section 25*c* of operation plate 25 is pressed reward. At this instance, operation plate 25, as can be seen in FIG. 7B moves reward such that its spreader 25*d* is placed in sliding contact with slopes 21*a* and 22*a* of engagement catches 21 and 22 to spread the spacing between engagement catches 21 and 22 in a reverse V-shape against the elasticity of compression springs 23 and 24. Thus, engagement between recess 11*a* of needle 11 and fitting sections 21*c* and 22*c* of engagement catches 21 and 22 are cancelled, in other words, disengaged or unlocked by lock section 29 to allow pin 14 to be removed from needle holder 30.

As typically shown in FIGS. 3 and 4, in the lateral mid portion of the front end of movable base 13, a curved notch 35 is defined, which notch 35 has a substantially triangular pointer 35*a* at its bottom end. The tip of pointer 35*a* points the distance between the sewing needle drop point and needle 11, in other words, the radius of the circular stitch indicated by scale 12*d* of the aforementioned main base 12. Thus, movable portion 13 can be located with main base 12 by laterally sliding movable base 13 along rail groove 12*e* by referring to scale 12*d* pointed by pointer 35*a*.

Referring further to FIGS. 8A, 8B, 9A, and 9B, a description will be given on operating element 18 which is operated to move movable base 13 and on recess 19 that allows operating element 18 to be stored into movable base 13.

As can be seen in FIGS. 4, and 8A to 9B, recess 19 is defined at the left end section of the front half of movable base 13 opposite of recess 17. Recess 19 comprises a front side recess 37 defined at the left corner of movable base 13 and a rear side recess 38 defined in wider width and reward relative to front side recess 37 and generally exhibiting a T-shape in plan view.

Figure 9A:
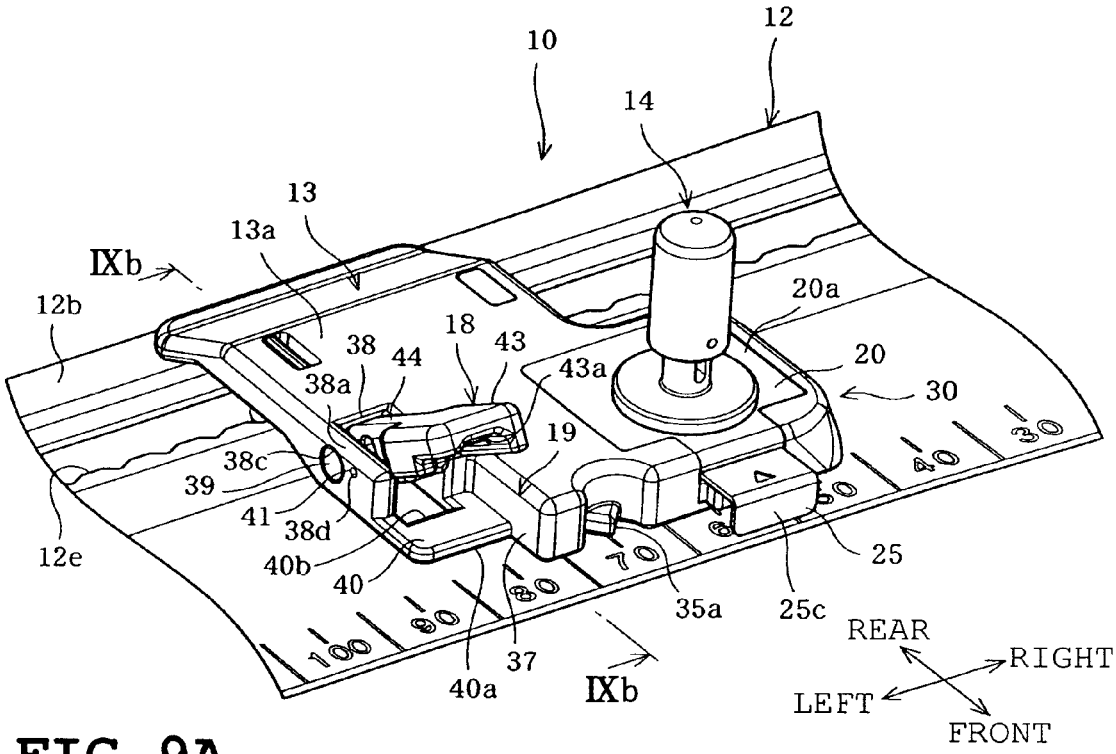
FIG. 9A is an enlarged perspective view of the proximity of the movable base with the operation element in the operative position.

As can be seen in FIG. 9A, front side recess 37 not only opens up upward but also leftward and forward. Bottom wall 40 of recess 19 is formed only at the portion corresponding to a portion of front side recess 37 such that a first notch 40*a* is defined by cutting off the front end of bottom wall 40 and a second notch 40*b* is defined at the portion corresponding to rear side recess 38 to obtain a space below operation element 18 identified as space S in FIG. 8B for inserting the fingertip of the user. As described in detail afterwards, bottom wall 40 also limits the swinging of operation element 18 and maintains the stored position shown in FIGS. 8A and 8B of operation element 18 through contact with the underside of operation element 18.

Rear side recess 38 opens up upward and downward and has a laterally extending support pin 39 and a regulatory pin 41 smaller in radius compared to support pin 39 provided at its rear portion. As shown in more detail in FIG. 4, left wall 38*a* and right wall 38*b* of rear side recess 38 each has a pin groove 38*c* defined that runs along the direction of movement of movable base 13 which pin groove 38*c* receives support pin 39 being pressed into it. Left wall 38*a* of rear side recess 38 is further provided with a pin hole 38*d* that laterally penetrates through it at a location obliquely forward upward from pin hole 38*c* for receiving a regulatory pin 41 pressed into it.

Operation element 18 or the operation tip is generally T-shaped to be received by recess 19 and includes a front tip 43 situated at the portion corresponding to front side recess 37 and a base end mount 44 situated at the portion corresponding to rear side recess 38.

At the rear end of mount 44, a through hole 44*a* is defined for insertion of support pin 39. Thus, operation element 18 is attached so as to be pivotable (swingable) about support pin 39 represented as pivot point C in FIG. 8B in a direction orthogonal to the direction of movement of movable base 13. As further shown in FIG. 8B, mount 44 has a vertically elongate long hole 44*b* defined forward relative to the outer peripheral edge of through hole 44*a*. Regulatory pin 41 is inserted into long hole 44*b* and regulatory pin 41 and long hole 44*b* regulates the swinging of operation element 18. That is, operation element 18, being limited in its pivotal movement within long hole 44*b* by regulatory pin 41, is regulated within the pivotal range between the operative position shown in FIGS. 9A and 9B protruding from upper surface 13*a* of movable base 13 and the stored position shown in FIGS. 8A and 8B stored within recess 19 so as not to protrude from upper surface 13*a*.

More specifically, the upper surfaces of tip 43 and mount 44 constituting upper surface 18*a* of operation element 18 are configured to be coplanar with upper surface 13*a* of movable element 13 when in the stored position. As further shown in FIGS. 4 and 8A, the front end surface and the left end surface of tip 43 are configured to be coplanar with the front end surface and the left end surface of movable base 13 respectively when operation element 18 is in the stored position. Tip 43, providing a fingertip grip is rectangular in plan view. At the front side of the underside of tip 43, a recess 43*a* constituting the aforementioned space S is defined so as to cave upward in an arc shape in front view. Operation element 18 maintains its stored position through the contact of rear portion of tip 43*a* underside with bottom wall 40 of recess 19.

Figure 9B:
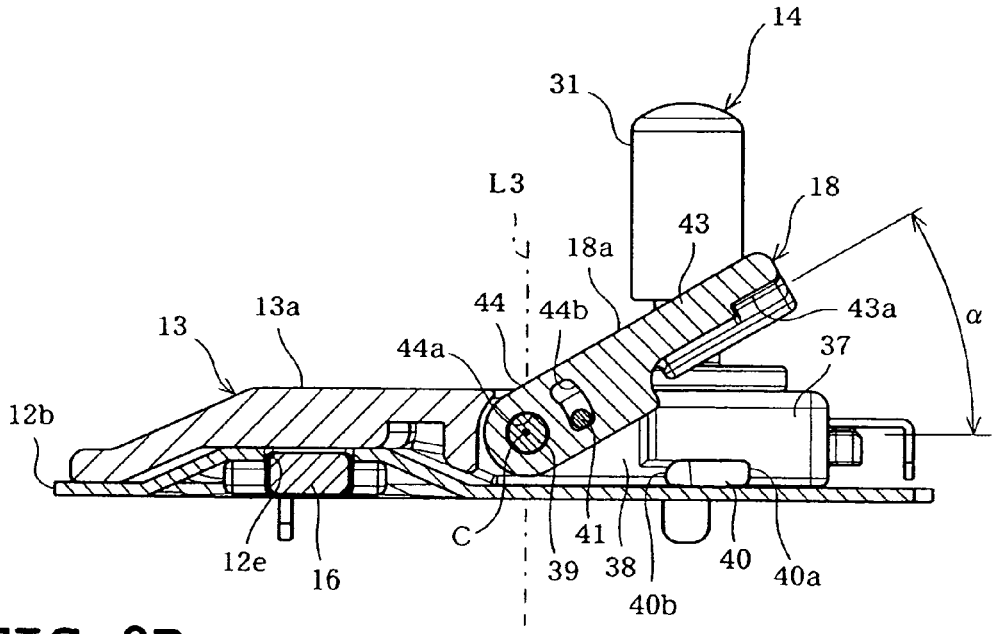
FIG. 9B is a cross sectional view taken along line IXb-IXb of FIG. 9A.

As can be seen in FIG. 9B, pivotal range a of operation element 18 is limited by regulatory pin 41 and long hole 44*b* or the so as not to be moved beyond vertical line L3 passing through pivot point C so that it stays forward relative to vertical line L3. That is, as obvious from FIG. 9B, operation element 18 is swung such that its center of gravity stays within range a residing forward relative to vertical line L3 and returns to the stored position from the operative position by gravity.

Next, a description will be given on the operation of circular stitcher 10.

As shown in FIG. 2, prior to execution of circular stitching, the user is to secure mount 12*a* of main base 12 to needle plate 1*a* by screw 15.

Then, movable base 13 is laterally moved relative to main base 12 to obtain the desired radius of circular stitching. At this instance, operation element 18 is placed in the stored position in which upper surface 18*a* is coplanar with upper surface 13*a* of movable base 13. Then, the user inserts his/her fingertips into space S below operation element 18 and grips handle 43 to move operation element 18 toward the operative position shown in FIGS. 9A and 9B. Since operation element 18 swings in the direction orthogonal to the direction of movement of movable base 13, movable base 13 will not be laterally moved unintentionally.

By laterally moving operation element 18, placed in the operative position protruding from upper surface 13*a* of movable base 13, along with movable base 13, movable base 13 can be positioned at the targeted position of scale 12*d* indicated by pointer 35*a*. After positioning movable base 13, the user is no further required to operate the operation element 18 and can just let operation element 18 to automatically return to the stored position from the operative position by gravity.

Thereafter, needle 11 of pin 14 is pierced through workpiece cloth CL at the position where center of circular stitching is to be located and needle 11 is attached to needle holder 30 of movable base 13. The attachment of needle 11 is facilitated by utilizing needle guide 28 of needle holder 30, more specifically, by guidance of conical portion 11*c* of needle 11 by each of grooves 28*a* to 28*c* to allow needle 11 to be readily inserted into through hole 20*b*. Needle 11 is attached to needle holder 30 without producing rattle by recess 11*a* being locked by lock element 29 at needle holder 30 and by being held by hole 20*b* and insert hole 27*a* as shown in FIG. 7A. At pin 14, since cover 32 is biased downward by the elasticity of compression coil spring 33, workpiece cloth CL is pressed downward by cloth presser 32*f* of cover 32 at placement surface 20*a* of needle holder 30 as shown in FIG. 6.

Circular stitcher 10 thus, locks center of circular stitching of workpiece cloth CL by needle 11 and the user may proceed with circular stitching through operation of sewing machine M. In cases such as forming a plurality of coaxial circular stitches, the aforementioned movable base 13 may be repositioned with workpiece cloth CL being locked by needle 11. In such cases, operation element 18 needs to be moved at the underside of workpiece cloth CL. However, since operation element 18 is disposed in front of movable base 13 and is provided with space S for fingertip insertion at its underside, switching the positioning of operation element 18 and lateral transfer operation can be readily performed.

In order to remove pin 14 from needle holder 30 after completion of circular stitching, press section 25*c* of operation plate 25 is pressed reward. Thus, the lock effected by lock element 29 at recess 11*a* of pin 11 is cancelled to allow pin 14 to be removed from needle holder 30.

As described above, circular stitcher 10 according to the present exemplary embodiment is provided at movable base 13 and is provided with operation element 18 operated by the user's fingertips to allow movement of movable base 13 in the predetermined direction. Thus, since movable base 13 can be moved by fingertip gripping of operation element 18 by the user, for example, relative positioning of movable base 13 to main base 12 can be readily adjusted depending upon the size of the circular stitches to be formed. Further, needle 11 is provided with recess 11*a*. By locking recess 11*a* of needle 11 by lock element 29, pin 14 can be attached to movable base 13 and by canceling the lock effected by lock element 29 on recess 11*a*, pin 14 can be removed from movable base 13. Thus, pin 14 can be reliably attached to and readily detached from movable base 13 to provide advantageous overall usability.

Operation element 18 is configured to be switchable between the operative position protruding from the upper surface of movable base 13 and the stored position without protruding from the upper surface of movable base 13. Thus, operation element 18 in the operative position can be easily gripped since it protrudes from the upper surface of movable base 13 to provide improved operability. By switching operation element 18 to the stored position in which operation element 18 does not protrude from the upper surface of movable base 13 when operation element 18 is not in use, operation element 18 will not interfere with the rotation of workpiece cloth CL and will not produce the problem of displacement in the circular stitches.

The base end of operation element 18 is supported swingably about pivot point C between the operative position and the stored position and is further configured to return to the stored position by gravity. By providing a pivotal structure in which the base end of operation element 18 serves as pivot point C, operation element 18 can be switched between the operative position and the stored position in a simple configuration. Since operation lever 18 returns automatically to the stored position by gravity, switching in the position of operation element 18 can be carried out without complicated operation and prevent sewing to be performed with operation element 18 protruding from upper surface 13*a* of movable base 13.

Operation element 18 is pivoted about pivot point C so as to swing in the direction orthogonal to the direction of movement of movable base 13. According to such configuration, since operation element 18 can be moved in the direction orthogonal to the direction of movement of movable base 13 when switching the position of operation element 18, movable base 13 can be prevented from being moved unintentionally.

Operation element 18 is disposed forward relative to movable base 13 and thus can be readily switched between the inoperative and stored position and also readily moved laterally. When workpiece cloth CL is locked by needle 11, operation element 18 needs to be operated below workpiece cloth CL. However, since the operation can be carried out forward relative to movable base 13, the user is advantageously allowed to operate with ease.

Operation element 18 is provided at one end of movable base 13 which is distal from the sewing needle drop point. According to the above described configuration, operation element 18 can be provided at a portion of movable base 13 as distant as possible from the sewing needle drop point, in other words, from sewing needle 5 to provide advantageous operability of operation element 18. Also, since pin 14 or needle 11 can be provided at a portion of movable base 13 proximal to the sewing needle drop point etc., operation element 18 will not pose a limitation in the design for allowing sewing of small-radius circular stitches.

The present disclosure is not limited to the above described exemplary embodiments but may be modified or expanded as follows.

Operation element 18 may be modified in its shape and/or positioning relative to movable base 13, etc. as long as such modified operation element 18 can be controlled to move movable base 13 in a predetermined direction. For instance, the pivotal range of movable base 13 may be modified as required within a range that allows control element 18 to return to the stored position by gravity. The element for regulating the pivotal range of operation element 18 only requires that an engagement portion is provided at either of operation element 18 and movable base 13 and an engagement subject provided at the remaining other of the two. Thus, engagement portion is not limited to regulatory pin 41 and engagement subject is not limited to long hole 44.

Further, lock element 29 is not limited to a couple of engagement catches 21 and 22, but may comprise a single or three or more engagement catches and needle 11 may come in any form as long as it is capable of piercing workpiece cloth CL and is provided with an engagement portion being locked and unlocked by lock element 29.

Main base 12 detachably attached to the upper surface of needle plate 1*a* may be detachably attached to the upper surface of the sewing machine bed.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A circular stitcher for a sewing machine that includes a sewing machine bed, a needle plate, and a feed dog, the circular stitcher having a needle configured to pierce a workpiece cloth at a laterally spaced position from a sewing needle drop point to form circular stitches on the workpiece cloth by rotating the workpiece cloth about the needle by the feed dog, the circular stitcher comprising:

a main base attachable to an upper surface of the sewing machine bed or to an upper surface of the needle plate;

a movable base provided at the main base so as to be movable in a predetermined direction with respect to the main base;

a pin including the needle configured to pierce the workpiece cloth and having an engagement portion, and a holder configured to hold a base end of the needle;

a lock element that is provided at the movable base and is configured to lock and unlock the engagement portion of the needle; and an operation element that is provided at the movable base and that is configured to allow a finger operation to move the movable base in the predetermined direction by a user.

2. The circular stitcher according to claim 1, wherein the operation element is configured to allow switching between an operative position in which the operation element protrudes from an upper surface of the movable base, and a stored position in which the operation element does not protrude from the upper surface of the movable base.

3. The circular stitcher according to claim 2, wherein the operation element includes a base end being swingably supported by the movable base so as to be swingable between the operative position and the stored position, and wherein the operation element swings back to the stored position by gravity.

4. The circular stitcher according to claim 3, wherein the operation element is supported swingably so as to swing in a direction orthogonal to a direction of movement of the movable base.

5. The circular stitcher according to claim 1, wherein the operation element is disposed at a front side of the movable base.

6. The circular stitcher according to claim 1, wherein the operation element is provided on a distal end of the movable base opposite a proximal end of the movable base which is proximal to the sewing needle drop point.

* * * * *